US007042399B2

(12) United States Patent
Noro et al.

(10) Patent No.: US 7,042,399 B2
(45) Date of Patent: May 9, 2006

(54) PATCH ANTENNA HAVING A NON-FEEDING ELEMENT FORMED ON A SIDE SURFACE OF A DIELECTRIC

(75) Inventors: Junichi Noro, Akita (JP); Toshiaki Aizawa, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/977,888

(22) Filed: Oct. 28, 2004

(65) Prior Publication Data

US 2005/0093747 A1 May 5, 2005

(30) Foreign Application Priority Data

Nov. 4, 2003 (JP) ..... 2003-374222

(51) Int. Cl.
*H01Q 1/38* (2006.01)

(52) U.S. Cl. ..... 343/700 MS

(58) Field of Classification Search ..... 343/700 MS, 343/702, 833, 834

See application file for complete search history.

(56) References Cited

U.S. PATENT DOCUMENTS 4,812,855 A * 3/1989 Coe et al. ..... 343/818
4,835,538 A * 5/1989 McKenna et al. ... 343/700 MS
5,008,681 A * 4/1991 Cavallaro et al. .... 343/700 MS
5,220,335 A * 6/1993 Huang ..... 343/700 MS
6,137,445 A * 10/2000 Ha et al. ..... 343/702
6,195,049 B1 * 2/2001 Kim et al. ..... 343/700 MS
6,567,045 B1 * 5/2003 Suguro et al. ..... 343/700 MS
6,903,692 B1 * 6/2005 Kivekäs et al. ..... 343/702
2004/0183735 A1 * 9/2004 Jecko et al. ..... 343/725

FOREIGN PATENT DOCUMENTS

JP 7-94934 A 4/1995
JP 11-284429 A 10/1999
JP 2003-163521 A 6/2003

* cited by examiner

*Primary Examiner*—Tan Ho
(74) *Attorney, Agent, or Firm*—Frishauf, Holtz, Goodman & Chick, P.C.

(57) ABSTRACT

In a patch antenna including a dielectric having a top surface, a bottom surface, and a side surface, a radiation element formed on the top surface of the dielectric, and a ground conductor formed on the bottom surface of the dielectric, a ring-shaped non-feeding element is formed on the side surface of the dielectric. The non-feeding element preferably may be formed on the side surface of the dielectric in the vicinity of the top surface of the dielectric. In addition, the non-feeding element may be formed by pasting a copper tape or by thick film printing.

4 Claims, 2 Drawing Sheets

10
12s
14
15
12u
12
16
12d
18

PATCH ANTENNA HAVING A NON-FEEDING ELEMENT FORMED ON A SIDE SURFACE OF A DIELECTRIC

This application claims priority to prior Japanese patent application JP 2003-374222, the disclosure of which is incorporated herein by reference.

BACKGROUND OF THE INVENTION

This invention relates to a digital radio receiver for receiving an electric wave from an artificial satellite (that may be called a "satellite wave") or an electric wave on the ground (that may be called a "terrestrial wave") to listen in a digital radio broadcasting and, in particular, to a patch antenna for use in the digital radio receiver.

In recent years, a digital radio receiver, which receives the satellite wave or the terrestrial wave to listen the digital radio broadcasting, has been developed and is put to practical use in the United State of America. The digital radio receiver is mounted on a mobile station such as an automobile and can receive an electric wave having a frequency of about 2.3 gigahertz (GHz) to listen in a radio broadcasting. That is, the digital radio receiver is a radio receiver which can listen in a mobile broadcasting. Inasmuch as the received wave has the frequency of about 2.3 GHz, a reception wavelength (resonance frequency) $\lambda$ thereof is equal to about 128.3 mm. In addition, the terrestrial wave is an electric wave in which a signal where the satellite wave is received in an earth station is frequency shifted a little.

Inasmuch as the electric wave having the frequency of about 2.3 GHz is used in the digital radio broadcasting in the manner which is described above, it is necessary to set up an antenna outside the automobile. Accordingly, the antenna must be attached to a roof of the automobile in a case where the digital radio receiver is mounted in the automobile.

It is necessary for the antennas of the type described to have a wide directivity. This is because it is necessary for the digital radio receiver to receive, from the artificial satellite, the satellite wave having a relatively low angle of elevation which laid in a range of 20 degrees and 60 degrees. In addition, the terrestrial wave has an angle of elevation which is substantially equal to zero degree.

In general, it is understood that antennas of planer-type (plane-type) such as patch antennas are unsuited for the antenna for use in the digital radio receiver because the antennas of planer-type (plane-type) has a narrow directivity. However, even a patch antenna, it is known that it is possible for the patch antenna to widen a directivity of an antenna by using a ground (earth) plate having a wide area (see, e.g. JP 2003-163521 A).

Particularly, in a case where the digital radio receiver is mounted in the automobile, its antenna is attached to the roof of the automobile in the manner which is described above. In this event, inasmuch as the roof of the automobile serves as the ground plate in itself, it is confirmed that it is possible for the patch antenna to sufficiently use the antenna for the digital radio receiver.

On the other hand, there is a demand to listen in the digital radio broadcasting not only in the inside of the automobile but also, for example, from a portable audio apparatus such as a compact disc (CD) radio-cassette recorder. In order to reply the demand, it is proposed to mount the patch antenna in a lid which is arranged on a top surface of a casing in the portable audio apparatus and which is openable for taking an optical disc into and out from the portable audio apparatus.

In this event, it is necessary to provide with the ground plate (earth plate) under the patch antenna.

In the manner which is described above, it is necessary for the patch antenna to use the ground plate having a large area in order to gain the directivity of the antenna in the low angle of elevation. However, when only the ground plate is provided, it is difficult to gain the directivity of the antenna in the low angle of elevation more. This is because the directivity of the patch antenna is uniquely determined by a size of the ground plate.

In addition, there is a microstrip antenna as one of the antennas of the planer-type. As the microstrip antenna, those where non-feeding elements are mounted at side edge portions of a top surface of an antenna substrate is known (see, e.g. JP 11-284429A). The non-feeding elements are mounted on the top surface of the antenna substrate by reason of inhibiting diffraction waves from an end part of a ground conductor. It is possible to improve an antenna characteristic in the microstrip antenna described in JP 11-284429 A. However, structure where the non-feeding elements are mounted on the top surface has large interference for a radiation element. In addition, inasmuch as it is impossible to adjust the non-feeding elements up and down, it is happened in a case where it is impossible to satisfy a desired antenna characteristic.

In addition, a compact plane patch antenna for use in a global positioning system (GPS) or the like is known (see, e.g. JP 07-094934 A). According to JP 07-094934 A, the compact plane patch antenna has high infrequency temperature characteristics and high reliability by using magnesium titanate ceramic having comparatively high dielectric constant as a main material for a dielectric material and adding the proper quantity of lithium niobate, alumina, manganese oxide, etc., individually or their combination at ions to the main material to mold the antenna.

SUMMARY OF THE INVENTION

It is therefore an object of the present invention to provide a patch antenna which is capable of ensuring a directivity of an antenna in a low angle of elevation.

It is another object of the present invention to provide a patch antenna unit which is capable of reducing interference for a radiation element.

It is still another object of the present invention to provide a patch antenna which is capable of easily adjusting an antenna characteristic in the low angle of elevation.

Other objects of this invention will become clear as the description proceeds.

According to an aspect of this invention, a patch antenna comprises a dielectric having a top surface, a bottom surface, and a side surface, a radiation element formed on the top surface of the dielectric, and a ground conductor formed on the bottom surface of the dielectric. The patch antenna further comprises a ring-shaped non-feeding element formed on the side surface of the dielectric.

In the patch antenna unit according to the aspect of this invention, the non-feeding element preferably may be formed on the side surface of the dielectric in the vicinity of the top surface of the dielectric. The non-feeding element may be formed by pasting a copper tape or may be formed by thick film printing.

DESCRIPTION OF THE PREFERRED EMBODIMENT

Figures 1, 2A, 2B, 2C, 2D, 2E, 2F:
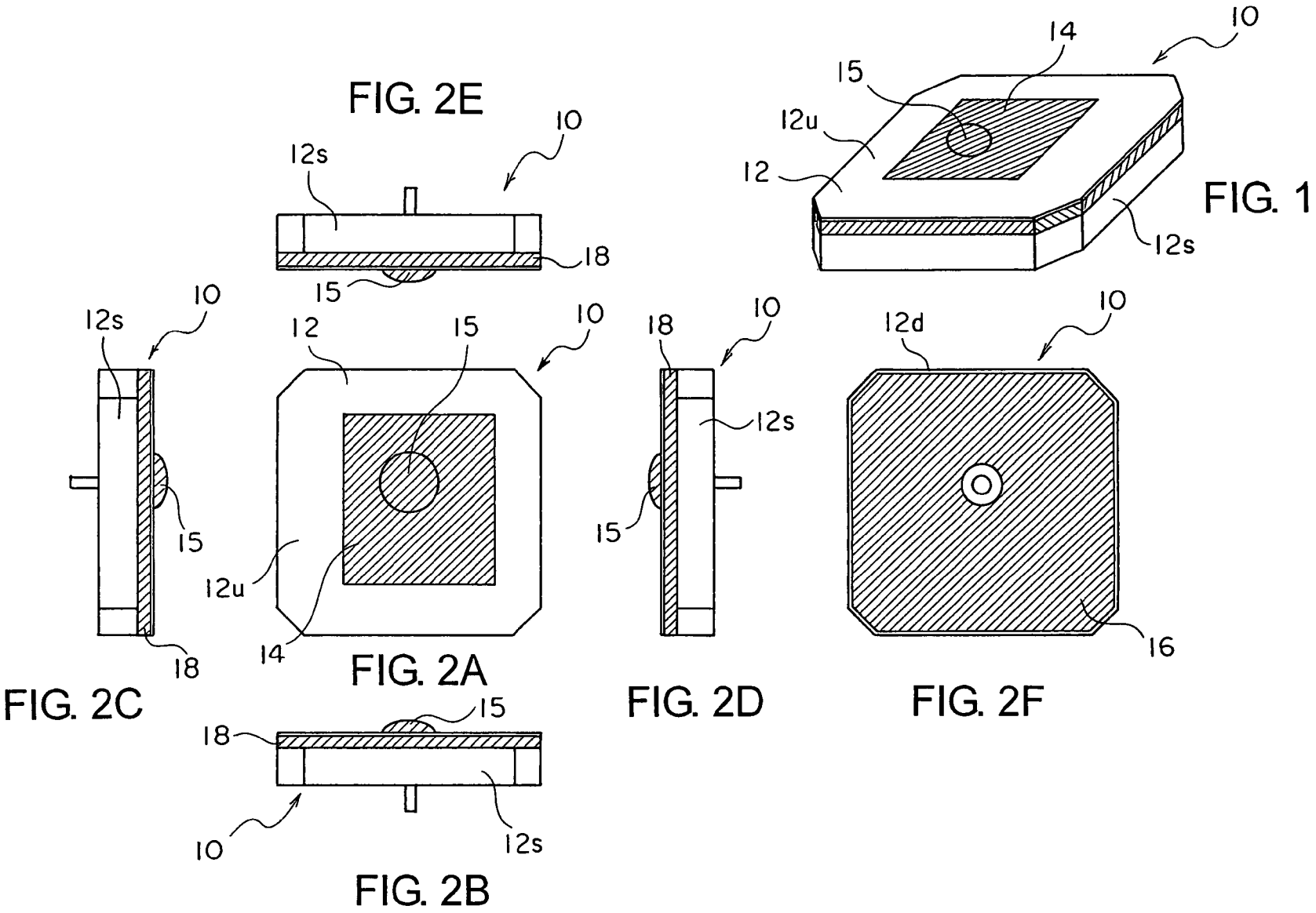
FIG. 1 is a perspective view of a patch antenna according to an embodiment of this invention.
FIG. 2A is a plan view of the patch antenna illustrated in FIG. 1.
FIG. 2B is a front view of the patch antenna illustrated in FIG. 1.
FIG. 2C is a left-hand side view of the patch antenna illustrated in FIG. 1.
FIG. 2D is a right-hand side view of the patch antenna illustrated in FIG. 1.
FIG. 2E is a rear view of the patch antenna illustrated in FIG. 1.
FIG. 2F is a bottom view of the patch antenna illustrated in FIG. 1.

Referring to FIG. 1 and FIGS. 2A, 2B, 2C, 2D, 2E, and 2F, the description will proceed to a patch antenna 10 according to an embodiment of the present invention. FIG. 1 is a perspective view of the patch antenna 10. FIG. 2A is a plan view of the patch antenna 10. FIG. 2B is a front view of the patch antenna 10. FIG. 2C is a left-hand side view of the patch antenna 10. FIG. 2D is a right-hand side view of the patch antenna 10. FIG. 2E is a rear view of the patch antenna 10. FIG. 2F is a bottom view of the patch antenna 10.

The patch antenna 10 comprises a dielectric 12 having configuration of a substantially rectangular parallelepiped. In the example being illustrated, the dielectric 12 has a length, a width, and a thickness which are equal to 20 mm, 20 mm, and 4 mm, respectively. The dielectric 12 is made of a ceramic material or resin. The dielectric 12 has a top or upper surface 12*u*, a bottom surface 12*d*, and a side surface 12*s*. Practically, in the manner which is illustrated in FIG. 1 and FIGS. 2A and 2F, the side surface 12*s* of the dielectric 12 has four corners which are chamfered.

On the top surface 12*u* of the dielectric 12, a radiation element 14 is formed. On the bottom surface 12*d* of the dielectric 12, a ground conductor 15 is formed. The patch antenna 10 has a feeding point 15.

On the side surface 12*s* of the dielectric 12, a ring-shaped non-feeding element 18 is formed. In the example being illustrated, the non-feeding element 18 is formed on the side surface 12*s* of the dielectric 12 in the vicinity of the top surface 12*u* of the dielectric 12. In addition, in the example being illustrated, the non-feeding element 18 is formed by pasting a copper tape. On behalf of this, the non-feeding element 18 may be formed by thick film printing.

Figure 3:
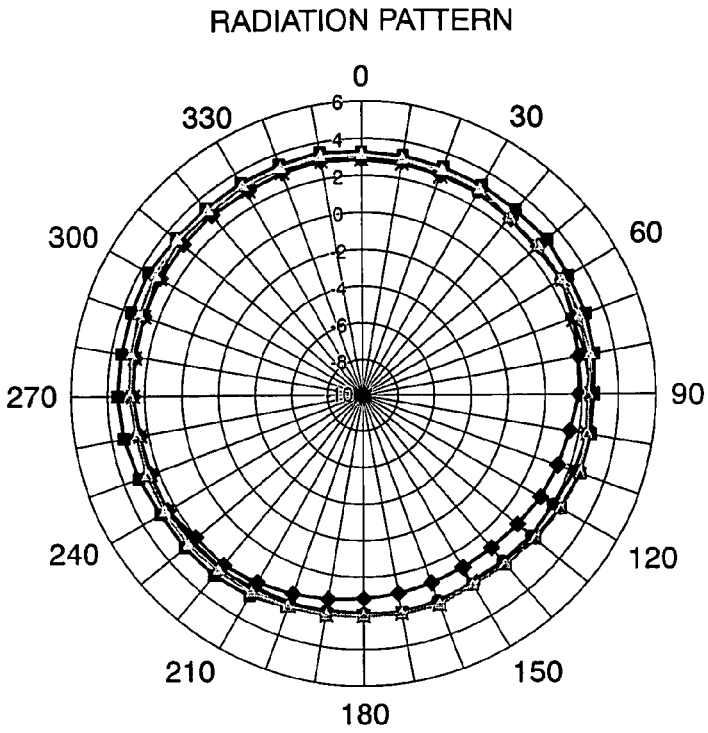
FIG. 3 shows an antenna radiation characteristic of the patch antenna comprising a ring-shaped non-feeding element illustrated in FIG. 1.
Figure 4:
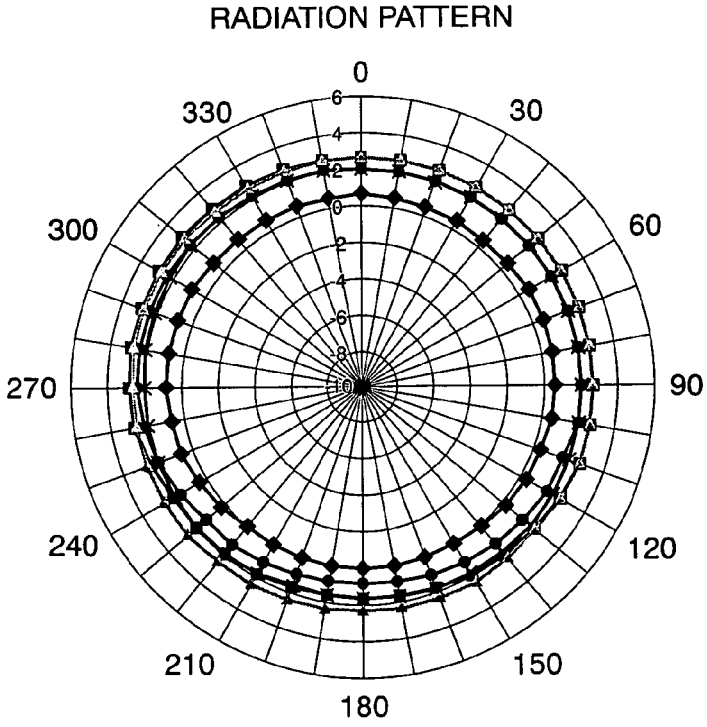
FIG. 4 PRIOR ART
FIG. 4 shows an antenna radiation characteristic of a conventional patch antenna without a ring-shaped non-feeding element.

FIG. 3 shows an antenna radiation characteristic of the patch antenna 10 comprising the ring-shaped non-feeding element 18 illustrated in FIG. 1 and FIGS. 2A through 2F at the frequency of 2.3 GHz. FIG. 4 shows an antenna radiation characteristic of a conventional patch antenna without the ring-shaped non-feeding element at the frequency of 2.3 GHz. FIGS. 3 and 4 show the antenna radiation characteristics in a case where the patch antenna is put on a center of a ground plate having a radius of four feet (about 120 cm). Each of FIGS. 3 and 4 shows gain characteristics in a circumferential direction in a case where the angle of elevation is equal to 20 degrees, 30 degrees, 40 degrees, 50 degrees, and 60 degrees.

From FIGS. 3 and 4, it is understood that the patch antenna 10 according to this invention has the gain which is larger than that of the conventional patch antenna. Specifically, in the angle of elevation of 30 degrees, the patch antenna 10 according to this invention has an average gain larger than that of the conventional patch antenna by 2.10 [dB].

Inasmuch as the non-feeding element 18 is formed on the side surface 12*s* instead of the top surface 12*u*, it is possible to reduce interference for the radiation element 14. In addition, it is possible to easily adjust the antenna characteristic in the low angle of elevation by adjusting a width and a position of the non-feeding element 18 up and down. Furthermore, it is unnecessary to enlarge a size of the antenna. This is because an area in the top surface 12*u* of the dielectric 12 does not change.

While this invention has thus far been described in conjunction with the preferred embodiment thereof, it will now be readily possible for those skilled in the art to put this invention into various other manners without departing from the scope of this invention.

What is claimed is:

1. A patch antenna comprising:

a dielectric having a top surface, a bottom surface, and a side surface;

a radiation element formed on the top surface of said dielectric;

a ground conductor formed on the bottom surface of said dielectric; and a ring-shaped non-feeding element formed on the side surface of said dielectric.

2. The patch antenna as claimed in claim 1, wherein said non-feeding element is formed on the side surface of said dielectric in the vicinity of the top surface of said dielectric.

3. The patch antenna as claimed in claim 1, wherein said non-feeding element is formed by pasting a copper tape.

4. The patch antenna as claimed in claim 1, wherein said non-feeding element is formed by thick film printing.

* * * * *